US007036902B2

(12) United States Patent
Shoji

(10) Patent No.: US 7,036,902 B2
(45) Date of Patent: May 2, 2006

(54) PRINTING APPARATUS

(75) Inventor: Michiharu Shoji, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 233 days.

(21) Appl. No.: 10/644,800

(22) Filed: Aug. 21, 2003

(65) Prior Publication Data

US 2004/0036732 A1 Feb. 26, 2004

(30) Foreign Application Priority Data

Aug. 22, 2002 (JP) ..... 2002-242034

(51) Int. Cl.
*B41J 29/393* (2006.01)

(52) U.S. Cl. ..... 347/14; 347/37; 347/19

(58) Field of Classification Search ..... 347/14, 347/19, 37; 358/463; 399/49, 249, 301; 382/167, 382/274, 260–264
See application file for complete search history.

(56) References Cited

U.S. PATENT DOCUMENTS 4,313,124 A 1/1982 Hara
4,345,262 A 8/1982 Shirato et al.
4,459,600 A 7/1984 Sato et al.
4,463,359 A 7/1984 Ayata et al.
4,558,333 A 12/1985 Sugitani et al.
4,723,129 A 2/1988 Endo et al.
4,740,796 A 4/1988 Endo et al.
6,515,445 B1 2/2003 Shoji et al.
6,592,198 B1 7/2003 Shoji et al.
6,599,043 B1 7/2003 Kobayashi et al.
6,711,364 B1 * 3/2004 Shinohara ..... 399/49
6,813,389 B1 * 11/2004 Gindele et al. ..... 382/274
2002/0171702 A1 11/2002 Kobayashi et al.
2002/0172510 A1 11/2002 Kobayashi et al.
2002/0172511 A1 11/2002 Saito et al.
2003/0043220 A1 3/2003 Shoji
2003/0052933 A1 3/2003 Shoji

* cited by examiner

*Primary Examiner*—Lamson Nguyen
(74) *Attorney, Agent, or Firm*—Fitzpatrick, Cella, Harper & Scinto

(57) ABSTRACT

A printing apparatus is equipped with a filter mechanism for achieving optimum digital encoder signal filtering so as to realize precise position control, for example. The printing apparatus filters out high-frequency noise overlaying a detection signal generated when detecting the position of a carriage on which a printhead is mounted and reciprocally moved in a first direction in such a way as to reflect the state of movement of the carriage and controls the printhead based on the filtered detection signal from which the noise is filtered out. Further, the printing apparatus may be configured to filter out high-frequency noise overlaying a detection signal generated by detecting a position of a printing medium according to conditions that reflect the state of conveyance by a conveyance mechanism and perform conveyance control of the printing medium based on the noise-filtered detection signal.

21 Claims, 13 Drawing Sheets

PRINTING APPARATUS

CLAIM OF PRIORITY

This application claims priority under 35 U.S.C. §119 from Japanese Patent Application No. 2002-242034, entitled "Printing Apparatus" and filed on Aug. 22, 2002, the entire contents of which are incorporated herein by reference.

FIELD OF THE INVENTION

The present invention relates to a printing apparatus, and more particularly, to a printing apparatus that prints using an inkjet printhead.

BACKGROUND OF THE INVENTION

As a means of printing an image (including text and symbols) on a printing medium such as paper or plastic film (for an OHP, for example) from input image information, an inkjet printing apparatus that is either built into or installed in a printer, facsimile machine, copier or the like is widely used in the prior art.

An inkjet printing apparatus prints by discharging ink droplets onto the printing medium from the printhead. Such apparatuses are easy to make compact, can print accurately at high speed, impose low running costs and are relatively quiet because they use a non-impact type of printing method. In addition, such apparatuses have the advantage of making color printing easy using multiple color ink.

These inkjet printing apparatuses are equipped with drive sources such as a carriage motor for reciprocally driving a carriage back and forth (hereinafter reciprocally driving) on which the printhead is mounted, an ASF (automatic sheet feeder) motor used for feeding a printing medium, a recovery system motor for head cleaning and the like, and a conveyance motor for conveying the printing medium with every printing scan of the printhead. Conventionally, stepping motors have been used in these types of drive sources because cost reductions come easily and control is simple.

In principle, an inkjet printing apparatus like that described above is relatively quiet because it uses a non-impact type printing method. However, it is becoming more common to use a DC motor as the above-described drive source in order to make the apparatus even quieter. In such cases, an encoder is typically used in order to obtain DC motor control information.

FIG. 10 is a schematic diagram showing an encoder structure.

The encoder, as shown in FIG. 10, is constructed so that a detector 703 detects light generated from an LED 701 via a code wheel 702 and generates a signal. On the code wheel 702 itself, alternating open portions through which light passes (704) and solid portions through which light does not pass (705) are disposed at set intervals, while photodiodes 706, 707, 708 and 709 are arranged at set intervals on the detector 703, with the light detected at each of the photodiodes 706–709 converted to electrical signal (A) 710, electrical signal (*A) 711, electrical signal (B) 712 and electrical signal (*B) 713, respectively, output, and the electrical signals 710–713 thus output are output by comparators 714 and 715 as differential output signals (channel A, channel B) 716, 717.

FIG. 11 is a signal waveform diagram showing a differential output signal waveform.

As shown in the diagram, a signal that inverts at the intersection of electrical signal (A) 801 and electrical signal (*A) 802 becomes channel A 803. If the carriage velocity is constant, ideally, the channel A 803 duty is 50 percent, that is, for one cycle of that signal, the time during which the signal level is HIGH and the time during which the signal level is LOW are identical (in FIG. 11, 50 percent each).

Generally, a signal that has been put through a digital LPF (low-pass filter) is used in order to eliminate noise when using a digital encoder signal.

FIG. 12 is a block diagram showing the structure of an LPF circuit.

As shown in FIG. 12, the LPF circuit forms a shift resister by connecting serially a plurality of DFF (D-type flip-flop). A digital encoder signal 605 is input to the shift resister and, each time a clock signal CLK 606 is input, sequentially the state of the DFF 601 is conveyed to DFF 602, the state of the DFF 602 is conveyed to DFF 603 and the state of DFF 603 is conveyed to DFF 604.

The Q outputs of each of the DFFs 602–604 are input to an AND circuit 607, and the output from the AND circuit 607 is connected to the J-input of a JKFF (J-K type flip-flop). At the same time, the inverted outputs of the DFFs 602–604 are input to another AND circuit 609 and the output of the AND circuit 609 is connected to the K-input of the JKFF 608.

By so doing, when all the output levels of the three DFFs 602–604 are HIGH, a HIGH signal is output from the AND circuit 607 and as a result the JKFF 608 outputs a HIGH signal. When all the output levels of the three DFFs 602–604 are low, a LOW signal is output from the AND circuit 607 and as a result the JKFF 608 outputs a LOW signal.

In short, only when the outputs of all three of the DFFs 602–604 match does the JKFF signal output level change. Accordingly, with a circuit of the structure shown in FIG. 12, in order to make the output from all three of the DFFs 602–604 match, the level of the digital encoder signal 605 must be constant for at least three clock signals or more.

In other words, signal changes that are shorter than 3 clock signal lengths in the digital encoder signal 605 are ignored.

In a structure of this type, when setting the LPF cut frequency low (that is, increasing the filtering effect), either the number of steps in the shift register may be increased or the cycle of the clock signal that sets the timing at which data is shifted may be prolonged.

However, in a circuit structure like that of the conventional example described above, when used with the digital encoder signal passed through the LPF, if the signal is put through the LPF after the digital encoder signal changes, until that digital encoder signal change is confirmed, a time delay occurs that corresponds to the number of steps in the LPF shift resister and the data shift timing.

That is, when the cut frequency is set low (the filtering effect is large), a large time delay occurs after the digital encoder signal changes and until that change is confirmed.

However, a problem arises in that this type of delay, for example in a case in which a digital encoder is used for the head drive control on a serial printer that prints by moving back and forth (that is, reciprocally) a printhead that discharges ink droplets, greatly increases the reciprocal registration adjustment for correcting the discharged position of the ink droplets during reciprocal printing.

Also, when performing control like that of a motor drive used for a serial printer, with its repeated stops, drives and reverses, that is, when there are large variations in velocity, when the digital encoder LPF cut frequency is low, that is, when the time from when the digital encoder signal changes until the time that change becomes confirmed is long, the difference between the physical position (the position at which the digital encoder signal changes) and the position determined by the encoder signal that has been passed through the LPF differs greatly between fast velocity and slow velocity. Accordingly, a great difference arises between the position recognized by the control circuit and the actual position of the carriage, which prevents precise positional control.

SUMMARY OF THE INVENTION

Accordingly, the present invention is conceived as a response to the above-described disadvantages of the conventional art.

For example, a printing apparatus according to the present invention is provided with a filter mechanism that is capable of always achieving optimum filtering of digital encoder signals in accordance with changes in the state of the carriage movement and the state of conveyance of the printing medium so as to realize precise position control.

According to one aspect of the present invention, preferably, a printing apparatus for printing on a printing medium by a printhead comprises scanning means, on which the printhead is mounted, for reciprocally moving the printhead in a first direction; conveyance means for conveying the printhead in a second direction different from the first direction; first detection means for detecting a position of the scanning means with respect to the first direction; first filter means for filtering out high-frequency noise overlaying a first detection signal generated by the first detection means according to conditions that reflect a movement condition of the scanning means; and printing control means for printing by controlling the printhead based on the first detection signal from which the noise has been filtered out by the first filter means.

Note that the scanning means preferably includes: a carriage on which the printhead is mounted; and a carriage motor for moving the carriage.

It should be noted that the first detection means preferably includes: (1) a scale, provided along the first direction, along which transparent and opaque regions are alternately provided at predetermined intervals; and (2) an encoder, provided on the carriage, that irradiates light onto the scale and generates an encoder signal as the first detection signal by detecting light that passes through any one of the transparent regions.

It should be further noted that the first filter means is a low pass filter (LPF) that filters out high-frequency noise overlaying the encoder signal.

And, the LPF preferably includes: (1) an edge detector for detecting a leading edge and a trailing edge of the encoder signal; (2) a mask signal generator for generating a mask signal of a predetermined length after detecting an edge by the edge detector; and (3) a level holder for holding a signal level of the encoder signal during a period of generating the mask signal.

Further note that not only the LPF has a first operating mode for operating so that the mask signal generator generates the mask signal of a predetermined time length, but also the LPF further measures a cycle of the encoder signal from the leading edge and the trailing edge of the encoder signal detected by the edge detector and has a second mode for operating so as to generate a mask signal of a length that is 1/n times as the cycle of the measured encoder signal.

Moreover, it is preferable that, in a case where the encoder generates at least a first encoder signal and a second encoder signal of different phases, the LPF further has a third operating mode for operating so as to generate the mask signal after the edge detector detects a change in signal level of the first encoder signal and until a signal level of the second encoder signal changes.

With the above-mentioned arrangement in the LPF, the printing control means preferably: (1) operates the LPF in the first operating mode while the carriage begins to accelerate from a state of rest to a time at which a change in a velocity of the carriage becomes stable; (2) operates the LPF in either the second mode or the third mode when the change in the velocity of the carriage becomes stable, the carriage continues to further accelerate until the carriage reaches a state of constant velocity movement, and up to a region in which the carriage begins to decelerate from the state of the constant velocity movement and such change in velocity becomes unstable; and (3) again operates the LPF in the first operating mode after the carriage reaches the region in which such change in velocity becomes unstable until the carriage stops.

Note that the printhead is preferably an inkjet printhead that prints by discharging ink, and the inkjet printhead is preferably provided with an electrothermal transducer for generating heat energy to be applied to ink so as to discharge the ink by utilizing the heat energy.

It is also preferable that the above printing apparatus further comprises: second detection means for detecting a position of the printing medium with respect to the second direction; second filter means for filtering out noise overlaying a second detection signal generated by the second detection means according to conditions which reflect a conveyance state by the conveyance means; and conveyance control means for performing conveyance control of the printing medium, based on the second detection signal from which the noise has been filtered out by the second filter means.

Note that an internal construction of the second filter means is preferably the same as that of the first filter means as described above.

Further note that the above conveyance means may include a conveyance roller and conveyance gear for conveying the printing medium, may include a paper feed roller and conveyance gear for conveying the printing medium, and/or may include a paper discharge roller and conveyance gear for conveying the printing medium.

Further note that the second detection means may include: a disk-like scale, provided on the conveyance gear, along which transparent and opaque regions are alternately provided at predetermined intervals; and a rotary encoder, provided near the conveyance gear, that irradiates light onto the scale and generates an encoder signal as the second detection signal by detecting light that passes through any one of the transparent regions.

In accordance with the present invention as described above, the high-frequency noise overlaying the detection signals generated by detecting the position of the scanning means on which the printhead is mounted and is reciprocally driven in a first direction is filtered out according to conditions that reflect the moving state of the scanning means, with printhead control carried out on the basis of the detection signals from which the noise has been filtered out.

The invention is particularly advantageous since the position of the scanning means is more accurately detected and as a result more accurate printing is carried out.

By so doing, printed images of better quality can be obtained.

In addition, high-frequency noise overlaying the detection signals generated by detecting the position of the printing medium is filtered out according to conditions that reflect the state of conveyance of the conveyance means, with conveyance control of the printing medium carried out on the basis of the detection signals from which the noise has been filtered out, so that more accurate printing medium conveyance position can be detected, as a result of which more accurate printing can be obtained.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention, in which.

DETAILED DESCRIPTION OF THE PREFERRED EMBODIMENTS

Preferred embodiments of the present invention will be described in detail in accordance with the accompanying drawings.

It should be noted that, in the embodiments described below, the description uses as an example a printing apparatus using a printhead according to an inkjet printing method.

In this specification, the terms "print" and "printing" not only include the formation of significant information such as characters and graphics, but also broadly include the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink (e.g., can solidify or insolubilize a coloring agent contained in ink applied to the print medium).

Furthermore, the term "nozzle" generally means a set of a discharge orifice, a liquid channel connected to the orifice and an element to generate energy utilized for ink discharge.

<Inkjet Printing Apparatus (FIG. 1)>

Figure 1:
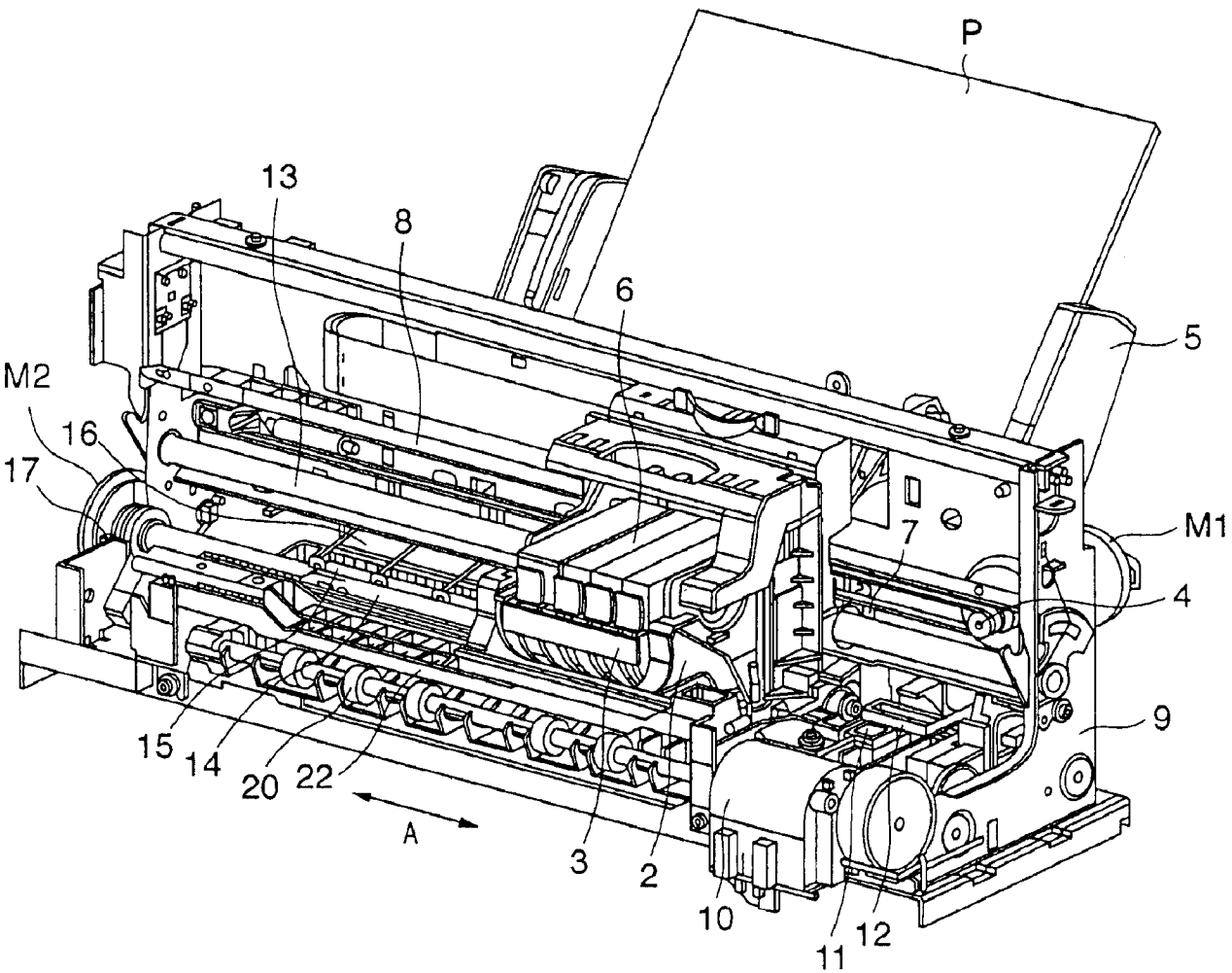
FIG. 1 is a perspective view of the overall construction of an inkjet printing apparatus, according to one typical embodiment of the present invention.

FIG. 1 is a perspective view showing the structure of an inkjet printing apparatus as a typical embodiment of the present invention.

As shown in FIG. 1, an inkjet printing apparatus (hereinbelow, referred to a "printing apparatus") 1 transmits a driving force generated by a carriage motor M1 to a carriage 2 holding a printhead 3, which performs printing by discharging ink in accordance with an inkjet method, by a transmission mechanism 4, and reciprocate-moves the carriage 2 in an arrow A direction, and, for example, supplies a print medium P such as a print sheet via a paper feed mechanism 5, conveys the print medium to a printing position, and performs printing by discharging ink from the printhead 3 onto the print medium P in the printing position.

Further, to maintain an excellent status of the printhead 3, the carriage 2 is moved to the position of a recovery device 10, and discharge recovery processing is intermittently performed on the printhead 3.

In addition to the printhead 3, an ink cartridge 6 containing ink to be supplied to the printhead 3 is attached to the carriage 2 of the printing apparatus 1. The ink cartridge 6 is removable from the carriage 2.

The printing apparatus 1 in FIG. 1 is capable of color printing, and for this purpose, has four ink cartridges containing magenta (M), cyan (C), yellow (Y) and black (K) inks. These four ink cartridges are respectively removable.

As junction surfaces of the carriage 2 and the printhead 3 are in appropriate contact, necessary electrical connection can be maintained between both members. The printhead 3 selectively discharges the ink from the plural discharge orifices by application of energy in correspondence with a print signal. Particularly in the present embodiment, the printhead 3 employs an ink-jet method of discharging ink utilizing thermal energy, has electrothermal transducers to convert applied electrical energy into thermal energy. The printhead 3 discharges the ink from the discharge orifices by utilizing pressure change caused by growth and shrinkage of bubbles by film boiling in the ink by application of thermal energy. The electrothermal transducers are provided corresponding to the respective discharge orifices, and the ink is discharged from corresponding discharge orifices by application of pulse voltage to corresponding electrothermal transducers in accordance with a print signal.

As shown in FIG. 1, the carriage 2 is connected to a part of a drive belt 7 of the transmission mechanism 4 to transmit the driving force of the carriage motor M1, and is slidably guided along a guide shaft 13 in the arrow A direction. Accordingly, the carriage 2 reciprocates along the guide shaft 13 by forward and reverse rotation of the carriage motor M1. Further, a scale 8 to indicate the absolute position of the carriage 2 is provided along the moving direction (arrow A direction) of the carriage 2. In this embodiment, as the scale 8, a transparent PET film on which black bars are printed is employed, and one end of the scale 8 is fixed to a chassis 9 while the other end is supported with a plate spring (not shown). The scale 8 has a structure like that of a code wheel described with reference to FIG. 10, in which transparent portions and opaque portions are alternately provided.

Further, the printing apparatus 1 is provided with a platen (not shown) opposite to a discharge orifice surface of the printhead 3 where the discharge orifices (not shown) of the printhead 3 are formed. The carriage 2 holding the printhead 3 is reciprocated by the driving force of the carriage motor M1, at the same time a print signal is supplied to the printhead 3 and the ink is discharged in accordance with the print signal, thereby printing is performed over the entire width of the print medium P conveyed onto the platen.

Further, in FIG. 1, numeral 14 denotes a conveyance roller driven by a conveyance motor M2 to convey the print medium P; 15, a pinch roller to bring the print medium P into contact with the conveyance roller 14 by a spring (not shown); 16, a pinch roller holder to rotatably support the pinch roller 15; and 17, a conveyance roller gear fixed to an end of the conveyance roller 14. The conveyance roller 14 is driven by rotation of the conveyance motor M2 transmitted via an intermediate gear (not shown) to the conveyance roller gear 17.

Further, numeral 20 denotes a discharge roller to discharge the print medium P where an image has been formed by the printhead 3 to the outside of the printing apparatus. The discharge roller 20 is driven by the rotation force transmitted from the conveyance motor M2. Note that the discharge roller 20 comes into contact with the print medium P by a spur roller (not shown) in press-contact with the discharge roller with a spring (not shown). Numeral 22 denotes a spur holder to rotatably support the spur roller.

Further, as shown in FIG. 1, the printing apparatus 1 is provided with a recovery device 10 to recover discharge failure in the printhead 3 in a desired position (e.g., a position corresponding to a home position) outside an area of the reciprocating motion of the carriage 2 holding the printhead 3 for printing operation (outside the printing area).

The recovery device 10 has a capping mechanism 11 to cap the discharge orifice surface of the printhead 3, and a wiping mechanism 12 to wipe the discharge orifice surface of the printhead 3. The recovery device 10 performs discharge recovery processing of forcibly discharging the ink from the discharge orifices by suction means (suction pump or the like) in the recovery device, in cooperation with capping on the discharge orifice surface by the capping mechanism 11, thereby removing viscosity-increased ink, bubbles and the like from the ink channels of the printhead 3.

Further, in a non-printing period, the discharge orifice surface of the printhead 3 is capped by the capping mechanism 11, thereby the printhead 3 is protected and evaporation and drying of the ink can be prevented. On the other hand, the wiping mechanism 12, provided around the capping mechanism 11, wipes out ink droplets adhered to the discharge orifice surface of the printhead 3.

The capping mechanism 11 and the wiping mechanism 12 make it possible to maintain ink discharge from the printhead 3 in good condition.

Moreover, an optical digital encoder (not shown in the diagram) is provided at the rear of the carriage 2 for irradiating light onto the scale 8 and measuring the absolute position of the carriage 2 from the light that passes through the scale. This digital encoder, like the one described with reference to FIG. 10, has an LED that irradiates light onto the scale 8, a detector that includes four photodiodes arranged at predetermined intervals for detecting light passing through the scale 8, and two comparators. By this configuration, two encoder signals of different phases are generated from the digital encoder.

<Control Construction of Inkjet Printing Apparatus (FIG. 2)>

Figure 2:
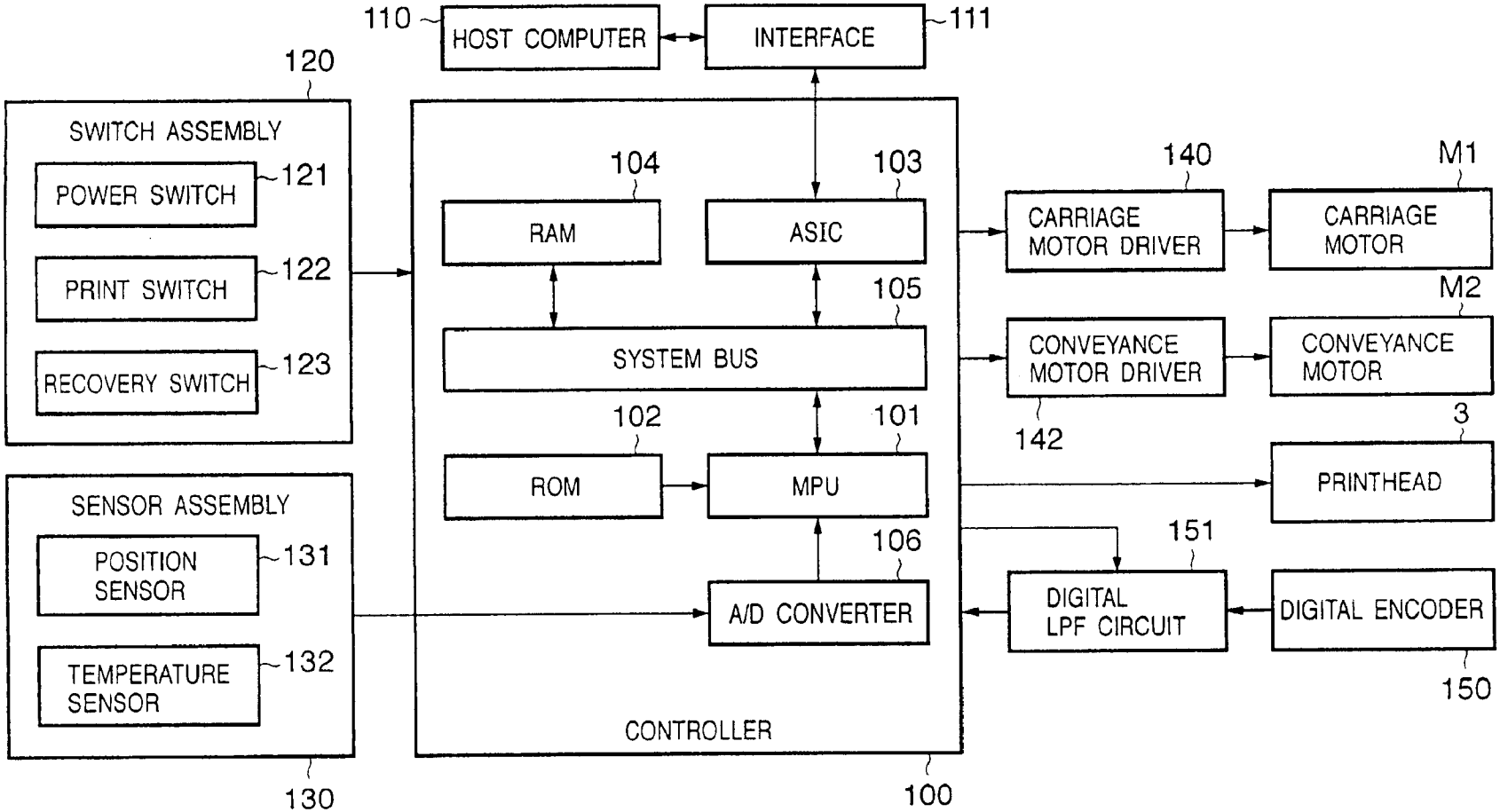
FIG. 2 is a block diagram showing the structure of a control circuit of the ink jet printing apparatus shown in FIG. 1.

FIG. 2 is a block diagram showing a control construction of the printing apparatus in FIG. 1.

As shown in FIG. 2, a controller 100 has an MPU 101, a ROM 102 storing a program corresponding to a control sequence to be described later, a required table and other fixed data, an Application Specific Integrated Circuit (ASIC) 603 for controlling the carriage motor M1 and the conveyance motor M2, and generating a control signal for the printhead 3, a RAM 104 including a bitmap area for mapping of image data and a work area for program execution, a system bus 105 interconnecting the MPU 101, the ASIC 103 and the RAM 104 for data transmission/reception, and an A/D converter 106 for inputting analog signals from a sensor assembly to be described below, then A/D-converting the signals and supplying digital signals to the MPU 101.

Further, in FIG. 2, numeral 110 denotes a computer as an image data supply source (otherwise an image reader or digital camera) referred to as a host device. Image data, command and status signals and the like are transmitted/received between the host device 110 and the printing apparatus 1 via an interface (I/F) 111.

Further, numeral 120 denotes a switch assembly comprised of switches to receive instruction inputs from an operator such as a power switch 121, a print switch 122 used for instructing to start printing and a recovery switch 123 used for instructing to start processing (recovery processing) to maintain an excellent ink discharge performance in the printhead 3. Numeral 630 denotes a sensor assembly to detect an apparatus status comprised of a position sensor 131 such as a photo coupler to detect a home position h, and a temperature sensor 132 provided in an appropriate position of the printing apparatus to detect an environmental temperature.

Further, numeral 140 denotes a carriage motor driver to drive the carriage motor M1 to reciprocate-scan the carriage 2 in the arrow A direction; and 142, a conveyance motor driver to drive the conveyance motor M2 to convey the print medium P.

The ASIC 103 forwards print signals to the printing elements (discharge heaters) while directly accessing the memory area of the RAM 102 when the printhead 3 print-scans.

In addition, the output of a digital encoder 150 is input to a controller 100 and used by the MPU 101 to execute carriage position control. It should be noted that the output of the digital encoder 150 is a signal similar to the differential output signal (Channel A, Channel B) shown in FIG.

10 in the conventional example. After passing through a digital LPF circuit 151 in order to filter out the noise, these signals are input to the controller 100. A detailed description of the structure of the digital LPF circuit 151 is reserved for later.

Next, a description is given of carriage position control in a printing apparatus having the structure described above.

First, consideration is given to the problems of the ordinary digital encoder.

Figure 3:
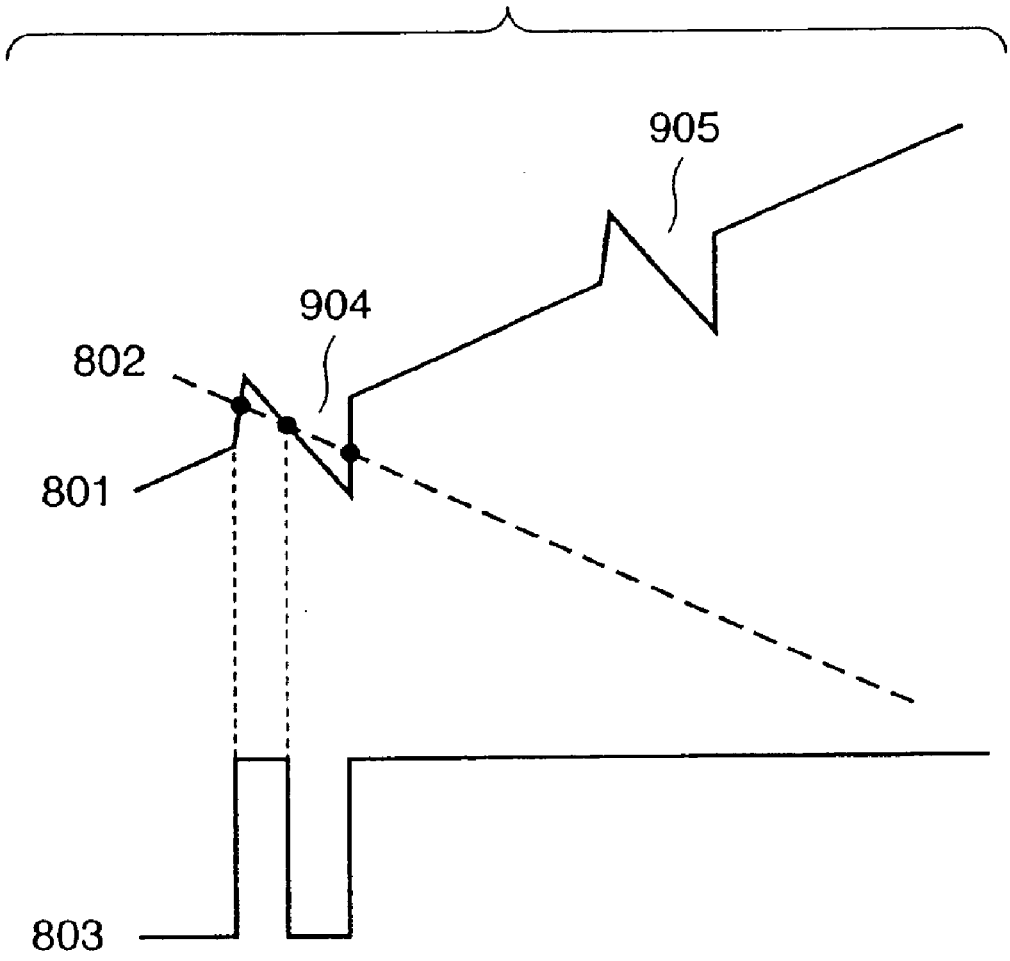
FIG. 3 is an enlarged signal diagram showing a digital encoder signal when noise occurs.

FIG. 3 is an enlarged signal diagram showing a digital encoder signal when noise occurs. In particular, the example shown in FIG. 3 enlarges the digital encoder signal when high-frequency noise occurs near the crossover point 804 between the electrical signal (A) 801 and the electrical signal (*A) 802 already shown in FIG. 11.

Here, in order to simplify the explanation, an instance is considered in which the noise only occurs at electrical signal (A) 801. That is, it is assumed that, when the leading edge of the electrical signal (A) 801 crosses electrical signal (*A) 802, the leading edge of the differential output signal (Channel A) 803 occurs, while when the trailing edge of the electrical signal (A) 801 crosses electrical signal (*A) 802, the trailing edge of the differential output signal (Channel A) 803 occurs.

Ordinarily, in the range of signal variation shown in FIG. 3, the leading edge of the electrical signal (A) 801 should intersect electrical signal (*A) 802 once and the leading edge of the differential output signal (Channel A) 803 should occur once. However, when noise 904 occurs in the vicinity of the intersection between electrical signal (A) 801 and electrical signal (*A) 802 as shown in FIG. 3, a plurality of crossover points are generated and, as a result, a plurality of changing points occurs in the differential output signal (Channel A) 803. This is called glitch.

By contrast, if noise 905 occurs at a point distant from the intersection between electrical signal (A) 801 and electrical signal (*A) 802 as shown in FIG. 3, the influence thereof does not readily show up in the differential output signal (Channel A) 803. Thus it can be seen that the digital encoder is structurally susceptible to noise near the point at which the changes of the differential output signals (Channels A, B) occur.

Figure 4:
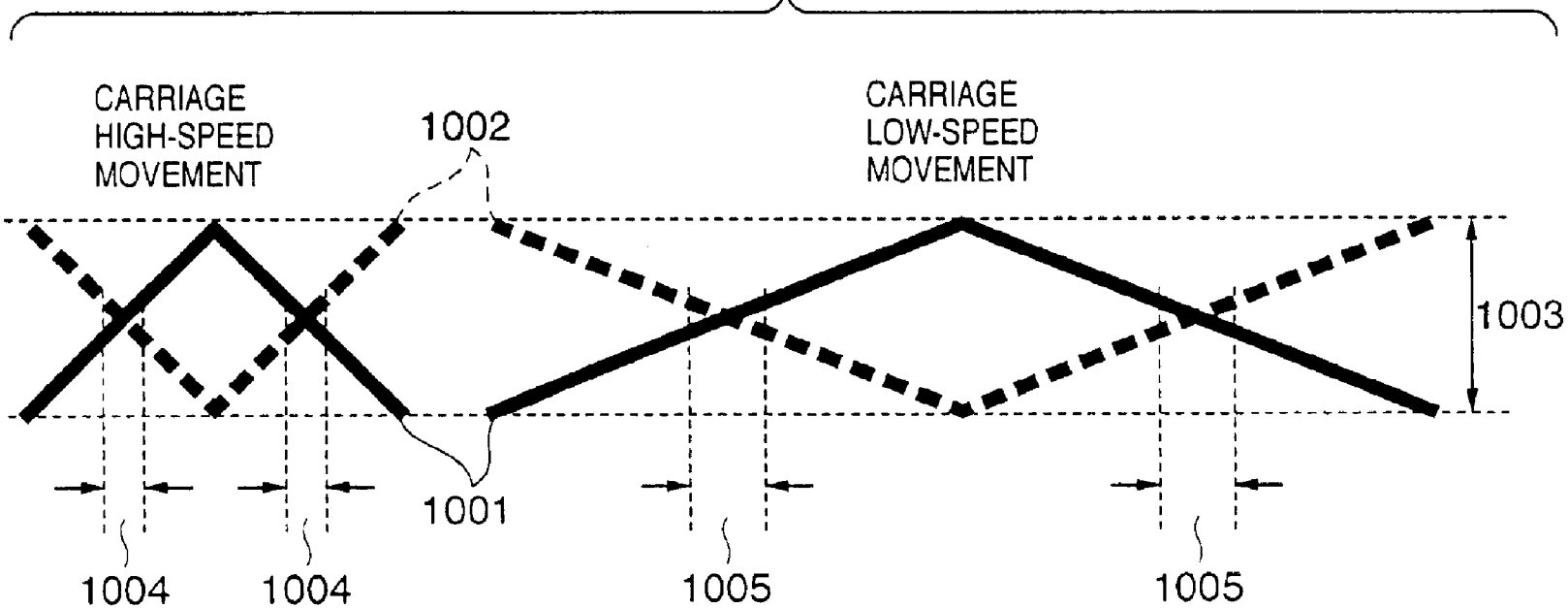
FIG. 4 is a diagram showing the influence generated by the carriage motor drive velocity of noise overlaying an electrical signal output from the digital encoder.

FIG. 4 is a diagram showing the influence generated by the carriage motor drive velocity of noise overlaying an electrical signal output from the digital encoder. In FIG. 4, the amplitude of the noise that may possibly occur at electrical signal (A) 1001 and electrical signal (*A) 1002 is indicated by the width of the lines of the electrical signals.

As shown in FIG. 4, regardless of whether the carriage motor drive is at fast speed or slow speed, that is, whether the carriage movement velocity is fast or slow, the amplitude 1003 of the electrical signals does not change. However, differences in the drive speed of the carriage motor, that is, differences in the carriage movement velocity, do cause differences in the angle at which the electrical signal (A) 801 and the electrical signal (*A) 802 intersect. As a result, the range t-slow 1005 over which it is possible for the electrical signal (A) 801 and the electrical signal (*A) 802 to intersect is longer when the carriage moves at low velocity than the range t_fast 1004 over which it is possible for these two electrical signals to intersect when the carriage moves at high velocity. In other words, glitch occurs more easily at low speed movement of a carriage than at high speed movement of the carriage.

Next, based on the foregoing study, a description is given of the structure and operation of the digital LPF circuit used in the present embodiment.

Figure 5:
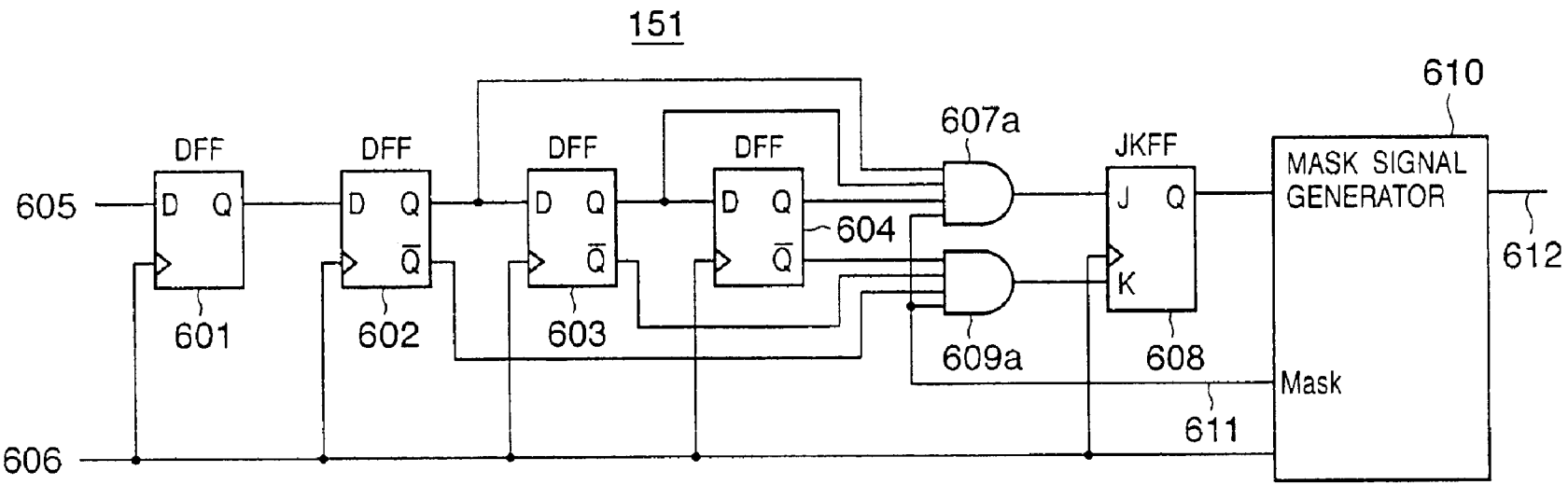
FIG. 5 is a block diagram showing the structure of a digital LPF circuit.
Figure 12:
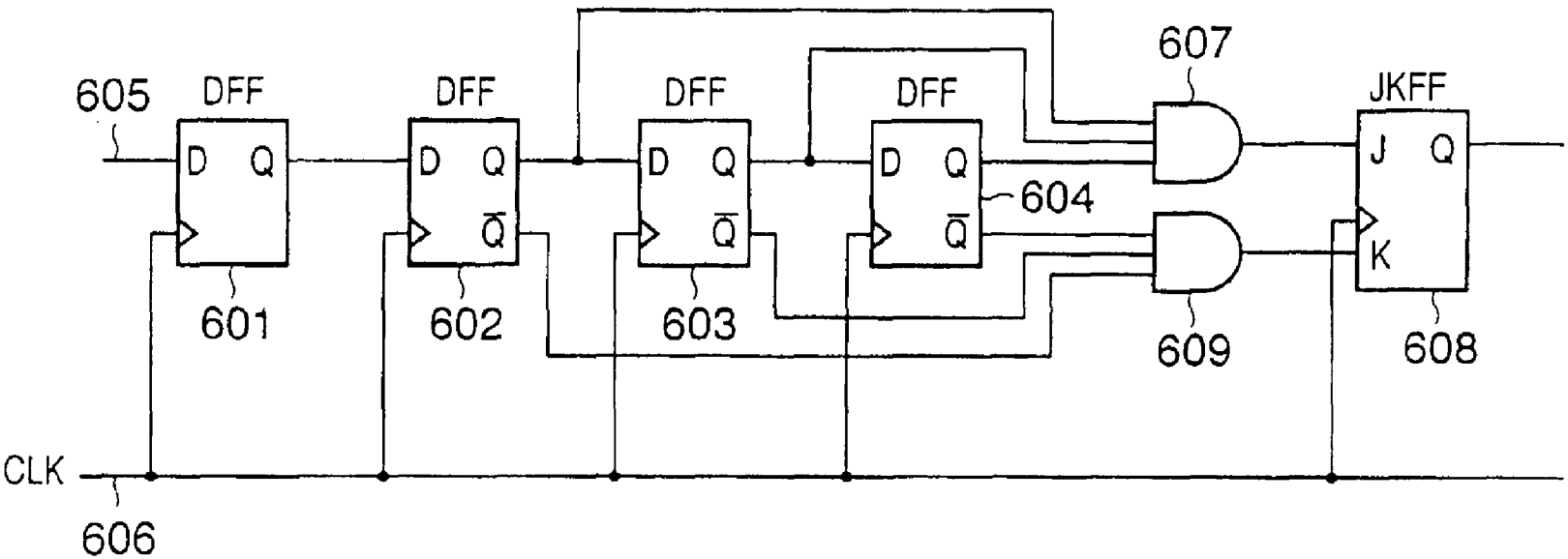
FIG. 12 is a block diagram showing the structure of the LPF circuit.

FIG. 5 is a block diagram showing the structure of a digital LPF circuit. It should be noted that, in FIG. 5, elements identical to those already described with respect to the conventional example of FIG. 12 are given the same reference numerals and a description thereof is omitted here.

Like the conventional example, the outputs of DFFs 602–604 are input to an AND circuit 607*a*, with the output of the AND circuit 607*a* connected to the J input of JKFF 608. The inverted outputs of DFFs 602–604, like the conventional example, are input to another AND circuit 609*a*, with the output of the AND circuit 609*a* connected to the K input of JKFF 608.

In the present embodiment, the JKFF 608 output is input to the mask signal generator 610, and the mask signal (Mask) 611 generated at the mask signal generator 610 is fed back to the AND circuit 607*a* and the AND circuit 609*a*. Note that the mask signal (Mask) 611 is a signal controlled so as to hold the signal level at LOW during a predetermined condition period from a detected edge of a filtered digital encoder signal generated by inputting the Q-output from the JKFF 608, low-pass-filtering it and removing noise.

Accordingly, with the digital LPF circuit configured as shown in FIG. 5, when all three outputs from DFFs 602–604 match and the mask signal (Mask) 611 level is HIGH, a HIGH is output from either one of the AND circuit 607*a* and the AND circuit 609*a*. The Q-output signal level from the JKFF 608 then changes with the next change in a signal level of the clock signal (CLK) 606.

Thus, the mask signal generator 610 detects the edge of the digital encoder signal and sets the mask signal (Mask) to LOW. By so doing, both output signals from AND circuits 607*a* and 609*a* continue to maintain at LOW. During that period of time there is no change in the level of the output from JKFF 608 and the mask signal generator 610 continues to maintain the level of the mask signal (Mask) 611 at LOW so long as certain predetermined conditions exist.

The predetermined conditions mentioned here are of three types:

(1) a fixed time mode, that outputs a LOW level signal for a preset fixed period of time;

(2) a velocity variable time mode, that measures an edge interval time of a digital encoder signal of an immediately preceding cycle and continues to hold a LOW level signal during a period that is n/m times the length of the edge interval; and (3) an off-phase signal change detection mode that continues to hold a LOW level signal during an interval extending from after a change in one of the two-phase digital encoder signals to the time the remaining signal also changes.

Next, a description is given of what kinds of encoder signals are obtained with each of these three conditions, with reference to the time charts of FIGS. 6A, 6B, 7 and 8.

(1) Fixed Time Mode

Figure 6A:
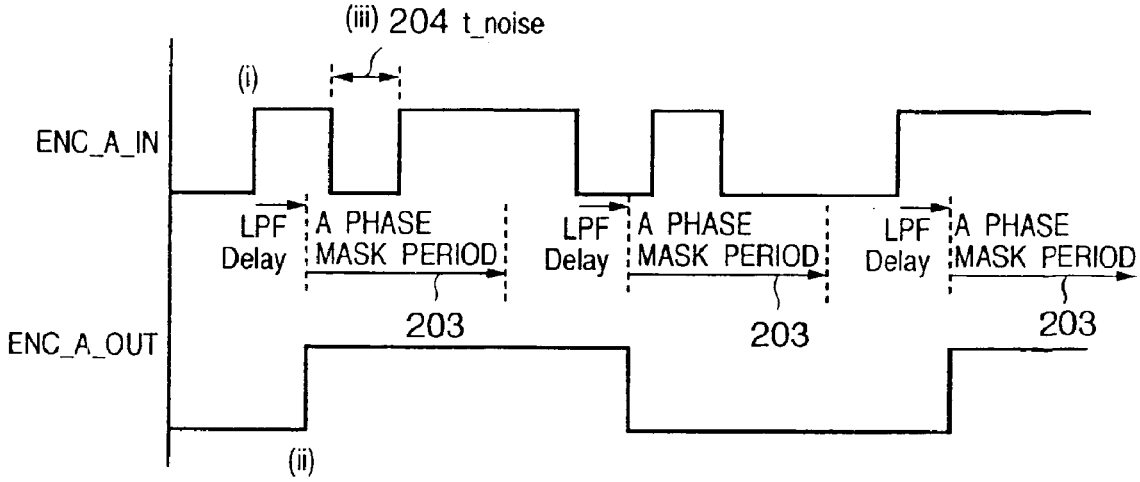
FIGS. 6A and 6B are time charts showing input-output signals of a digital LFP circuit in a fixed time mode.
Figure 6B:
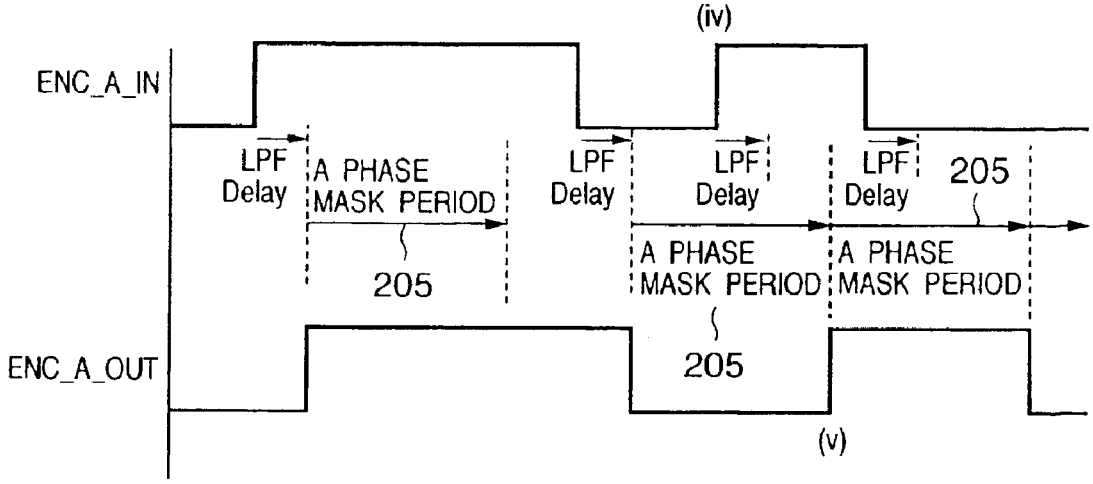

FIGS. 6A and 6B are time charts showing input-output signals of a digital LFP circuit in a fixed time mode.

In FIGS. 6A and 6B, ENC_A_IN is an input signal from the digital encoder 150 and ENC_A_OUT is the digital encoder signal from which noise has been filtered out by the digital LPF filter circuit 151. If reference is made to FIG. 5, these correspond to the encoder signal 605 and the output signal 612 from the mask signal generator circuit 610. It should be noted that these reference numerals are also used for FIGS. 7 and 8, to be described below.

After the ENC_A_IN changes from LOW level to HIGH level ((i) in FIG. 6A), the digital encoder signal level is confirmed after a time delay (LPF Delay) caused by the digital LPF circuit (at this point the filtered encoder signal edge is detected) and the ENC_A_OUT signal level changes ((ii) in FIG. 6B). From that point on, the level of the mask signal 611 becomes LOW, that is, a mask interval 203 is commenced. If there is noise having a pulse width (t_noise) 204 that cannot be filtered out by the digital LPF circuit ((iii) in FIG. 6A) within this mask interval 203, such noise is removed by the masking. Here, the mask interval 203 is a preset length of time that is always constant.

In addition, in a case where the ENC_A_IN changes from LOW to HIGH during the mask interval 205 ((iv) in FIG. 6B), although the HIGH level is confirmed after the delay period, since the mask period 205 has not ended yet, the HIGH level of ENC_A_IN has not reflected on the level of ENC_A_OUT yet. Thus, the ENC_A_OUT still remains LOW. Thereafter, when the mask period ends, the HIGH level of ENC_A_IN reflects on the level of ENC_A_OUT. Finally, the level of ENC_A_OUT becomes HIGH ((v) in FIG. 6B).

In other words, according to this embodiment, during the mask period, the level of ENC_A_OUT does not change (the level change is prohibited). For the simplicity of explanation, some of the LPF delay periods are omitted in FIG. 6A. According to FIGS. 6A and 6B, the level change of ENC_A_IN triggers initiation of LPF delay processing, while the level change of ENC_A_OUT triggers initiation of mask processing. In other words, at a timing when the level of ENC_A_IN changes, the LPF delay processing starts. At a timing when the level of ENC_A_OUT changes, the mask processing starts.

In the fixed time mode, position information does not fail even when the carriage is stopped or its direction of movement is reversed.

(2) Velocity Variable Time Mode

Figure 7:
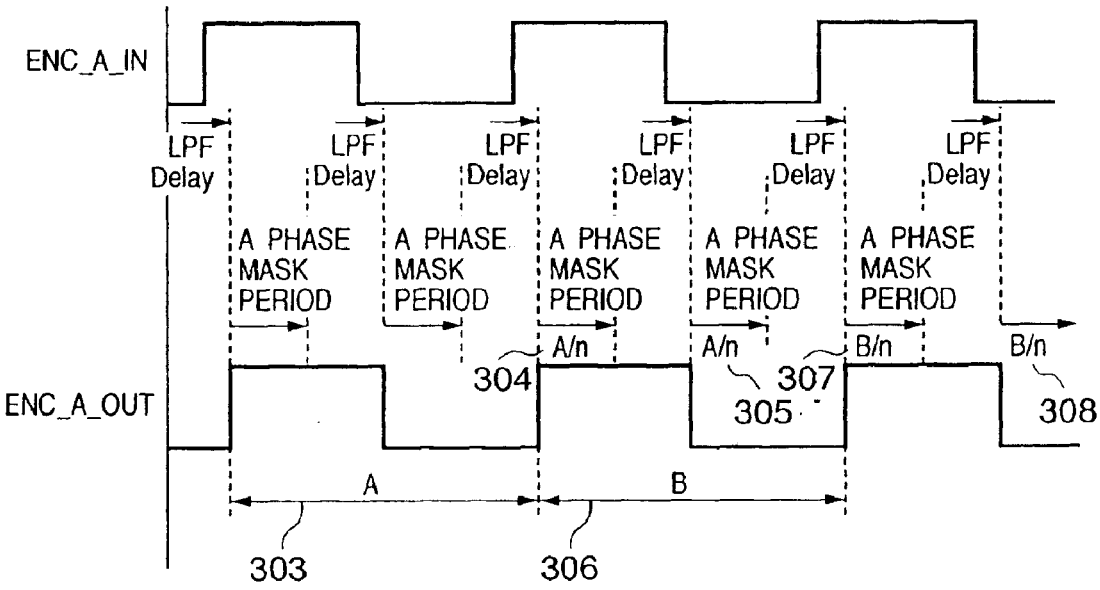
FIG. 7 is a time chart showing input-output signals of a digital LFP circuit in a velocity variable time mode.

FIG. 7 is a time chart showing input-output signals of a digital LFP circuit in a velocity variable time mode. It should be noted that, even in this mode, operations within the mask interval are basically the same as those of the fixed time mode shown in FIGS. 6A and 6B.

However, in the velocity variable time mode, the method of determining the length of the mask interval is different from that in the fixed time mode described above. The length of the mask interval in the velocity variable time mode changes depending on the velocity state at the time. Here, the immediately preceding digital encoder cycle is used for the velocity at that time.

That is, in the velocity variable time mode as shown in FIG. 7, the mask interval having a proportion (for example, 1/n) defined for the cycle (A) 303 of the filtered digital encoder signal (ENC_A_OUT) is used as the mask intervals 304, 305 until the next velocity information is confirmed. After the next velocity information, that is, the next cycle (B) 306 of the digital encoder signal (ENC_A_OUT) is confirmed, the mask intervals 307, 308 having a proportion defined for cycles (B) up to the confirmation of the next velocity information is used. By so doing, the mask interval changes according to the carriage movement velocity such that, when the carriage moves slowly (that is, the digital encoder edge interval is wide) the mask interval is long, while when the carriage moves fast (that is, the digital encoder edge interval is narrow) the mask interval is short, thus making it possible to remove noise efficiently.

(3) Off-Phase Signal Change Detection Mode

When the direction of movement of the carriage does not change, the two-phase digital encoder signal (ENC_A_In and ENC_B_IN) changes according to a fixed pattern. Accordingly, if two phases of the digital encoder signals are labeled as phase A and phase B, respectively, and the direction of movement of the carriage 2 does not change, phase B always changes once phase A changes and vice-versa. The off-phase signal change detection mode makes use of this pattern of change.

Figure 8:
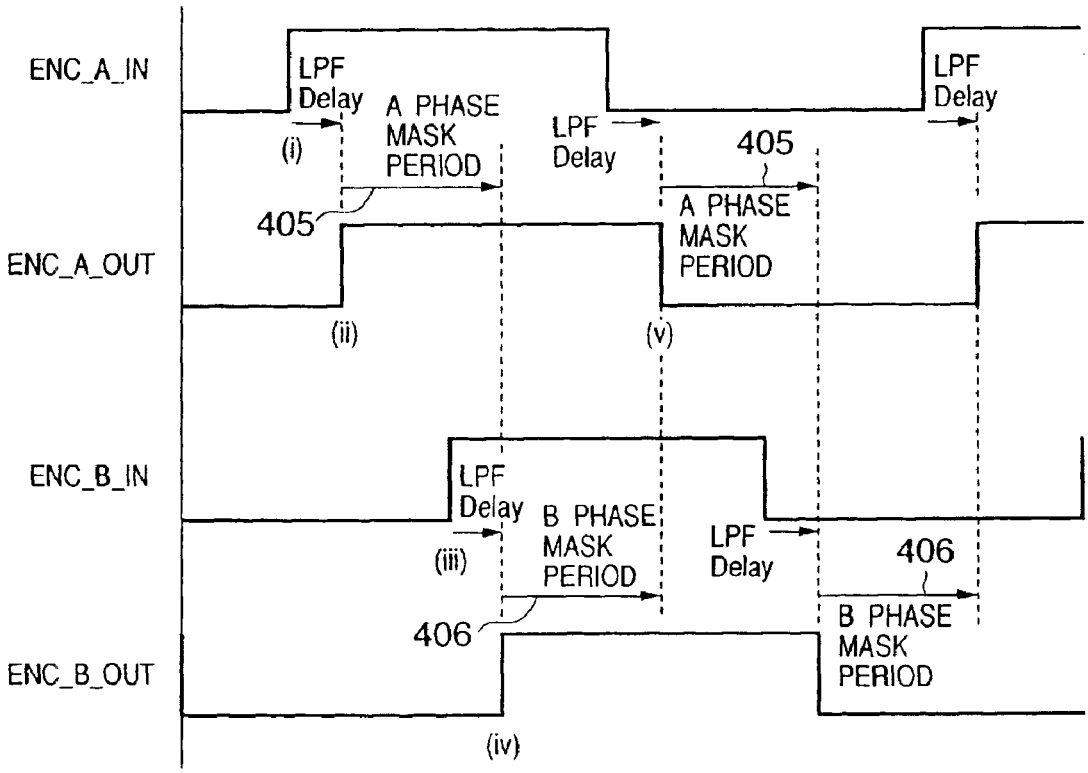
FIG. 8 is a time chart showing input-output signals of a digital LFP circuit in an off-phase signal change detection mode.

FIG. 8 is a time chart showing input-output signals of a digital LFP circuit in an off-phase signal change detection mode.

In FIG. 8, ENC_B_IN is another phase digital encoder signal input to the digital LPF circuit and ENC_B_OUT is a digital encoder signal from which the noise has been filtered out by the digital LPF circuit. Operations within the mask interval are basically the same as those for the fixed time mode shown in FIG. 6.

After the ENC_A_IN signal level has changed from LOW to HIGH, ((i) in FIG. 8), and after time delay in the digital LPF circuit (LPF Delay), the signal level is confirmed and the signal level of the ENC_A_OUT changes ((ii) in FIG. 8). This change is detected at the mask signal generator circuit 610, and from that point on the A phase mask signal becomes LOW, that is, the A phase mask interval 405 commences.

Thereafter, if the direction of movement of the carriage does not change, the other phase signal, that is, ENC_B_IN changes ((iii) in FIG. 8) and, after the time delay in the digital LPF circuit, the signal level is confirmed and the level of ENC_B_OUT changes ((iv) in FIG. 8). At this point, as soon as the A phase mask interval 405 terminates, the B phase mask interval 406 commences. Similarly, the B phase mask interval 406 is continued until the next change in ENC_A_OUT.

In this method as well, the mask interval changes according to the carriage movement velocity as it does in the velocity variable time mode described with reference to FIG. 7 above. Thus, when the carriage moves slowly (that is, the digital encoder edge interval is wide) the mask interval is long, and when the carriage moves fast (that is, the digital encoder edge interval is narrow) the mask interval is short, thus making it possible to remove noise efficiently.

A description is now given of a case where a digital LPF circuit having the structure and operation described above is adapted to the operation of an inkjet printing apparatus.

The carriage drive in an inkjet printing apparatus basically involves repeated STOP and GO driving.

Figure 9:
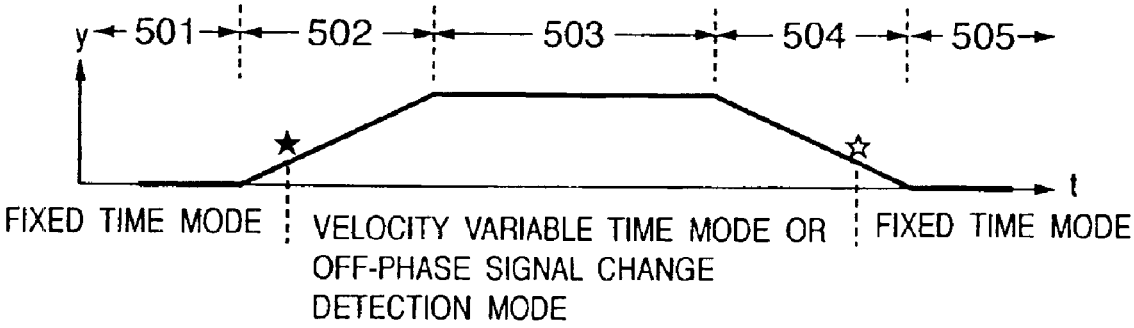
FIG. 9 is a diagram showing status changes in STOP and GO driving of the carriage.

FIG. 9 is a diagram showing status changes in STOP and GO driving of the carriage. In FIG. 9, the horizontal axis represents time (t) and the vertical axis represents carriage movement velocity (v).

As shown in FIG. 9, the STOP and GO involves a repetition of a stopped state 501, an acceleration state 502, a constant velocity state 503, a deceleration state 504 and another stopped state 505.

In the present embodiment, the three operating modes of the digital LPF circuit 151 are switched and used according to the movement of the carriage in a manner described below. The switching between operating modes is carried out by the MPU 101 or the ASIC 103 which integrates the digital LPF circuit 151 controlling the control signals of the digital LPF circuit 151 depending on servo status or carriage movement velocity information.

In other words, the apparatus is operated in the fixed time mode as the carriage moves from the stopped state 501 to the acceleration state 502, reaches a predetermined velocity (indicated by the ★ mark in FIG. 9) and the change in velocity becomes stable. Further the apparatus is operated in either the velocity variable time mode or the off-phase signal change detection mode as the carriage changes from a state where the velocity change has stabilized to the constant velocity state 503 and a state where the change in velocity is still stable in the deceleration state 504 (indicated by the ☆ mark in FIG. 9). Thereafter, the apparatus switches once more to the fixed time mode when the deceleration state 504 approaches the stopped state 505.

It should be noted that, since the carriage moves reciprocally, the stopped state includes both a state in which the carriage movement is from a forward direction to a backward direction and vice versa.

Therefore, according to the above-described embodiment, even when the carriage movement velocity changes greatly, by changing the mode of the digital LPF circuit, filtering can be performed efficiently according to the state of movement of the carriage, the impact of glitch can be minimized and more accurate encoder signals can be generated. More specifically, the fixed time mode, in which the position information does not shift even in a case where a carriage stops or a case where the direction of movement of the carriage is reversed, is used during a period from a state where the carriage stops to a state where the velocity of the carriage is not so fast. In a case where the change in velocity is great, the velocity variable time mode (or the off-phase signal change detection mode), in which the mask interval can be changed to track the change in velocity, is used.

By so doing, noise can be filtered out effectively without creating a great time delay after a digital encoder signal changes, and as a result carriage position detection accuracy can be enhanced, ink discharge positions can be determined more accurately and better quality image printing can be carried out.

It should be noted that, in the above-described present embodiment, the digital encoder and the digital LPF circuit are described in terms of their adaptation to carriage movement control. However, as can be appreciated by those of ordinary skill in the art, the digital encoder and digital LPF circuit can be equally suitably adapted to the printing medium conveyance control, which requires accurate positional detection.

Figure 10:
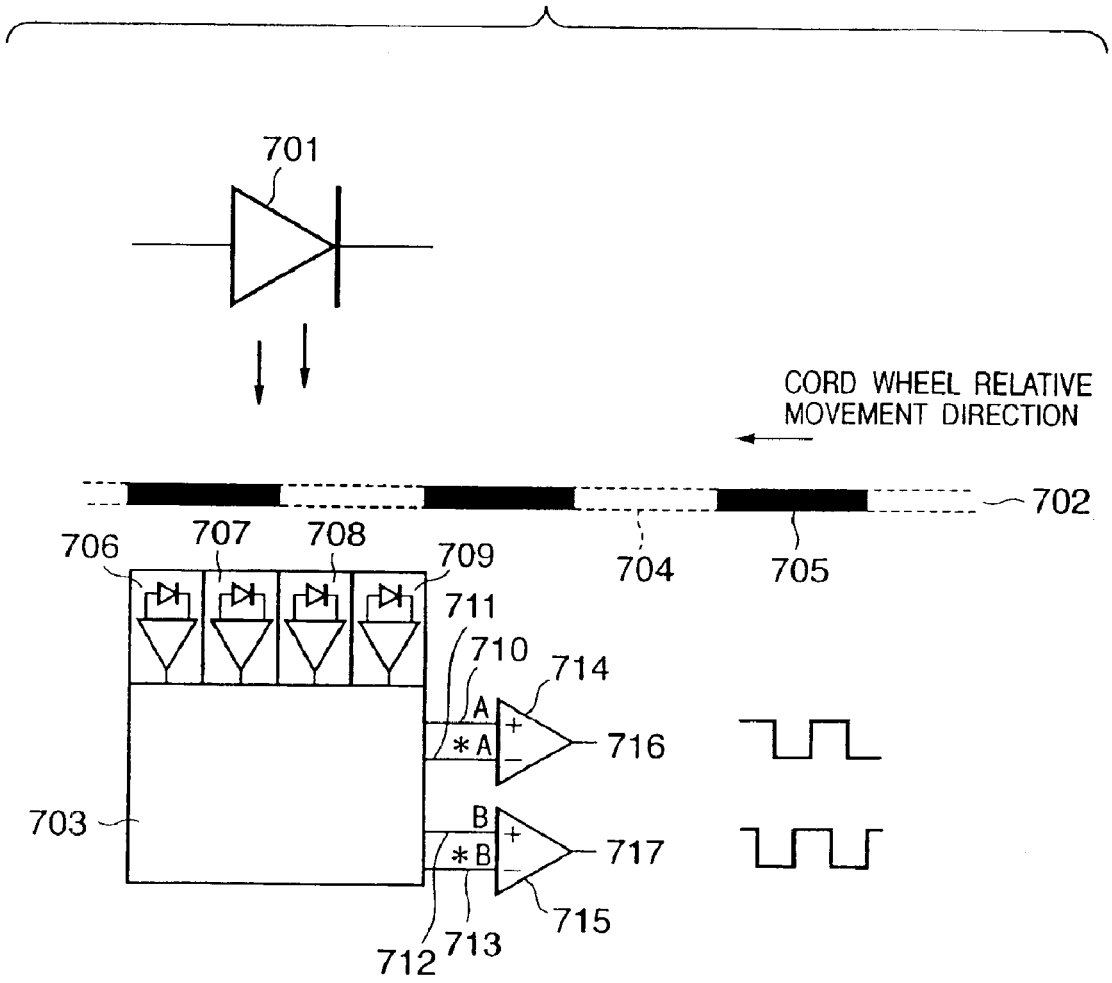
FIG. 10 is a schematic diagram showing an encoder structure.

In such cases, a code wheel like that shown in FIG. 10 may be provided along the periphery of the conveyance roller gear 17 that is one part of the conveyance mechanism for the printing medium which is driven by the conveyance motor M2. In addition, a rotary encoder configured so as to pass light from an LED through the code wheel, detect the light that passes through the code wheel using a detector provided with a plurality of photodiodes disposed at predetermined intervals and then generate encoder signals from the detection, may be provided in the vicinity of the conveyance roller gear 17. With such an arrangement, noise may be filtered out of the encoder signals generated from the rotary encoder at the digital LPF circuit having the above-described structure.

In addition, although the above-described embodiment uses an optical encoder, a magnetic encoder may be substituted therefore. For example, a scale magnetized in alternate orientations at predetermined intervals and the encoder, provided on the carriage, for detecting the directions of magnetization so as to generate an encoder signal may be provided.

Figure 13:
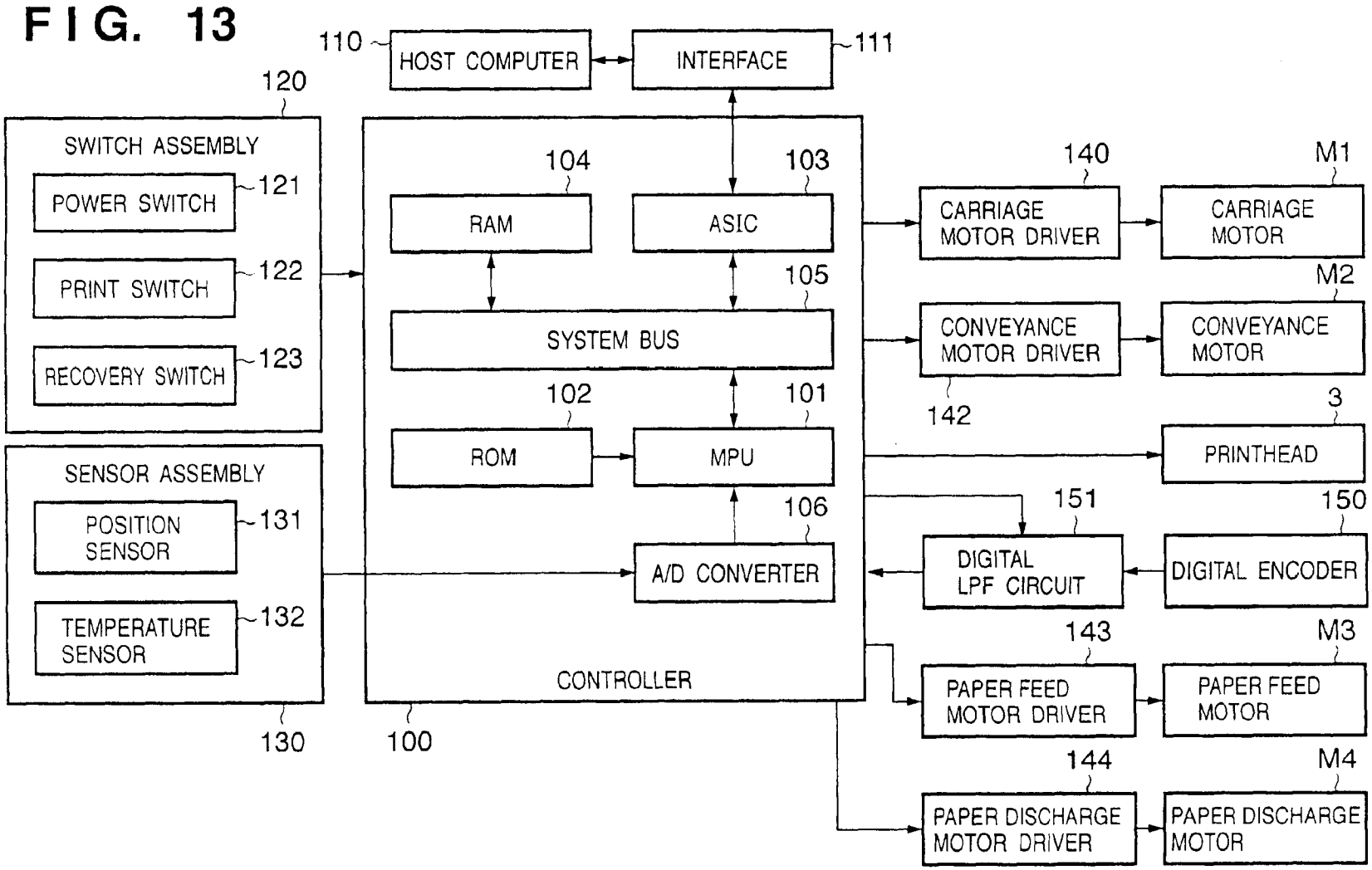
FIG. 13 is a block diagram showing another structure of the control circuit of the inkjet printing apparatus of the present invention.

It should be noted that FIG. 13 is a block diagram showing another structure of the control circuit of the inkjet printing apparatus of the present invention. Portions that are the same as those in FIG. 2 are designated by the same reference numerals. In FIG. 13, the following parts have been added to that shown in FIG. 2: paper feed motor M3, paper discharge motor M4, paper feed motor driver 143 and paper discharge motor driver 144 for driving the paper feed motor M3 and paper discharge motor M4, respectively.

With the above-described structure, the paper feed mechanism and paper discharge mechanism each has its own dedicated motor, so the paper feed mechanism and the paper discharge mechanism can each be operated independently and consequently the throughput from paper feed to paper discharge can be improved.

Besides the paper feed motor, the paper feed mechanism also comprises rotating members such as a paper feed roller, a gear and so forth for transmitting the driving force of the motor. Similarly, besides the paper discharge motor, the paper discharge mechanism also comprises rotating members such as a paper discharge roller, a gear and so forth. A rotary encoder may be provided on rotary members of the paper feed mechanism and paper discharge mechanism and the encoder signal noise may be filtered out at the above-described digital LPF circuit.

Figure 11:
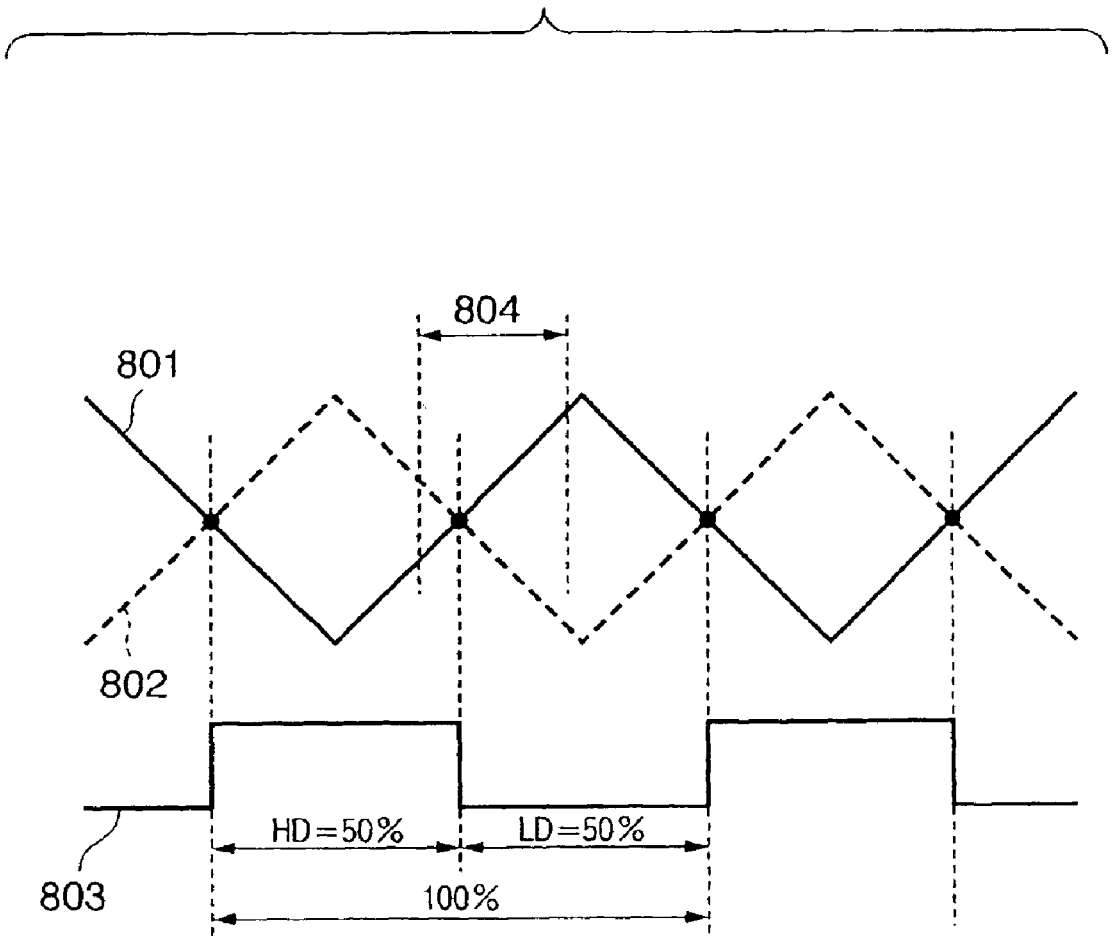
FIG. 11 is a signal waveform diagram showing a differential output signal waveform.

As described above, the present invention focuses on a high frequency noise which is generated around the intersection 804 between the electrical signal (A) 801 and the electrical signal (*A) 802 shown in FIG. 11. With the above arrangement, the present invention can remove the high frequency noise which is generated around the intersection 804 between the electrical signal (A) 801 and the electrical signal (*A) 802 shown in FIG. 11. Thus, according to the present invention, occurrence of plural level changes as shown in FIG. 3 can be prevented, and the number of level changes near/in each intersection between the electrical signal (A) 801 and the electrical signal (*A) 802 shown in FIG. 11 becomes "ONE".

In other words, in response to a timing when the levels of the electrical signal (A) 801 and the electrical signal (*A) 802 intersect, a leading edge and trailing edge of the differential output signal (Channel A) 803 are generated. By virtue of this feature, the controller 100 can obtain accurate position information and speed information from the digital encoder 150.

Note that, although there is still a possibility that a noise is generated at a slightly earlier timing than that at the intersection 804, even though the timing is regarded as the real intersection, such a timing error is very little and still negligible.

Although operation modes in the digital LPF circuit 151 with respect to the stopped state 501, the acceleration state 502, the constant velocity state 503, the deceleration state 504, and the stopped state 505 shown in FIG. 9 have been described, the present invention is not limited to these operation modes.

For example, there is a case where a carriage moves at a relatively short distance for a recovery operation. In such a case, the controller 100 controls the carriage motor M1 such that it is driven at a constant speed. In this case, the above-mentioned fixed time mode is used. Also, in a case where a printing medium moves at a relatively short distance by driving the conveyance motor M2, the controller 100 controls the conveyance motor M2 such that it is driven at a constant speed. In this case, only the fixed time mode may be used.

When driving at least one of the carriage motor M1 and the conveyance motor M2, if the change of the speed during the acceleration and deceleration is very small, only the fixed time mode may be used.

Note that in the above embodiment, the liquid discharged from the printhead has been described as ink, and the liquid contained in the ink tank has been described as ink. However, the liquid is not limited to ink. For example, the ink tank may contain processed liquid or the like discharged to a print medium to improve fixability or water repellency of a printed image or to increase the image quality.

The embodiment described above has exemplified a printer, which comprises means (e.g., an electrothermal transducer, laser beam generator, and the like) for generating heat energy as energy utilized upon execution of ink discharge, and causes a change in state of an ink by the heat energy, among the ink-jet printers. According to this ink-jet printer and printing method, a high-density, high-precision printing operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of the so-called on-demand or continuous type systems. Particularly, in the case of the on-demand type, the system is effective because, by applying at least one driving signal, which corresponds to printing information and gives a rapid temperature rise exceeding nucleate boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the printhead, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention.

Furthermore, as a full line type printhead having a length corresponding to the width of a maximum printing medium which can be printed by the printer, either the arrangement which satisfies the full-line length by combining a plurality of printheads as disclosed in the above specification or the arrangement as a single printhead obtained by forming printheads integrally can be used.

In addition, an exchangeable chip type printhead which can be electrically connected to the apparatus main body and can receive ink from the apparatus main body upon being mounted on the apparatus main body can be employed as well as a cartridge type printhead in which an ink tank is integrally arranged on the printhead itself as described in the above embodiment.

It is preferable to add recovery means for the printhead, preliminary auxiliary means and the like to the above-described construction of the printer of the present invention since the printing operation can be further stabilized. Examples of such means include, for the printhead, capping means, cleaning means, pressurization or suction means, and preliminary heating means using electrothermal transducers, another heating element, or a combination thereof. It is also effective for stable printing to provide a preliminary discharge mode which performs discharge independently of printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printhead or by combining a plurality of printheads.

Moreover, in each of the above-mentioned embodiments of the present invention, it is assumed that the ink is a liquid. Alternatively, the present invention may employ an ink which is solid at room temperature or less and softens or liquefies at room temperature, or an ink which liquefies upon application of a use printing signal, since it is a general practice to perform temperature control of the ink itself within a range from 30° C. to 70° C. in the ink-jet system, so that the ink viscosity can fall within a stable discharge range.

In addition, in order to prevent a temperature rise caused by heat energy by positively utilizing it as energy for causing a change in state of the ink from a solid state to a liquid state, or to prevent evaporation of the ink, an ink which is solid in a non-use state and liquefies upon heating may be used. In any case, an ink which liquefies upon application of heat energy according to a printing signal and is discharged in a liquid state, an ink which begins to solidify when it reaches a printing medium, or the like, is applicable to the present invention. In the present invention, the above-mentioned film boiling method is most effective for the above-mentioned inks.

In addition, the ink-jet printer of the present invention may be used in the form of a copying machine combined with a reader and the like, or a facsimile apparatus having a transmission/reception function in addition to an image output terminal of an information processing apparatus such as a computer.

As many apparently widely different embodiments of the present invention can be made without departing from the spirit and scope thereof, it is to be understood that the invention is not limited to the specific embodiments thereof except as defined in the appended claims.

What is claimed is:

1. A printing apparatus for printing on a printing medium by a printhead, the apparatus comprising:

scanning means, on which the printhead is mounted, for reciprocally moving the printhead in a first direction;

conveyance means for conveying the printing medium in a second direction different from the first direction;

first detection means for detecting a position of said scanning means with respect to the first direction;

first filter means for filtering out high-frequency noise overlaying a first detection signal generated by said first detection means according to conditions that reflect a movement condition of said scanning means; and printing control means for printing by controlling the printhead based on the first detection signal from which the noise has been filtered out by said first filter means.

2. The apparatus according to claim 1, wherein said scanning means includes a carriage motor for moving a carriage on which the printhead is mounted.

3. The apparatus according to claim 2, wherein said first detection means includes:

a scale, provided along the first direction, along which transparent and opaque regions are alternately provided at predetermined intervals; and an encoder, provided on said carriage, that irradiates light onto the scale and generates an encoder signal as the first detection signal by detecting light that passes through any one of the transparent regions.

4. The apparatus according to claim 3, wherein said first filter means is a low pass filter (LPF) that filters out high-frequency noise overlaying the encoder signal.

5. The apparatus according to claim 4, wherein said LPF includes:

an edge detector for detecting a leading edge and a trailing edge of the encoder signal;

a mask signal generator for generating a mask signal of a predetermined length after detecting an edge by the edge detector; and a level holder for holding a signal level of the encoder signal during a period of generating the mask signal.

6. The apparatus according to claim 5, wherein said LPF has a first operating mode for operating so that the mask signal generator generates the mask signal of a predetermined time length.

7. The apparatus according to claim 6, wherein said LPF further includes includes a measuring unit for measuring a cycle of the encoder signal from the leading edge and the trailing edge of the encoder signl detected by the edge detector, and has a second mode for operating sos as to generate a mask signal of a length that is $1/n$ times the cycle of the encoder signal measured by the measuring unit.

8. The apparatus according to claim 7, wherein said encoder generates at least a first encoder signal and a second encoder signal of different phases, and said LPF further has a third operating mode for operating so as to generate the mask signal after the edge detector detects a change in signal level of the first encoder signal and until a signal level of the second encoder signal changes.

9. The apparatus according to claim 8, wherein said printing control means operates said LPF in the first operating mode while the carriage begins to accelerate from a state of rest to a time at which a change in a velocity of the carriage becomes stable, said printing control means operates said LPF in either the second mode or the third mode when the change in the velocity of the carriage becomes stable, the carriage continues to further accelerate until the carriage reaches a state of constant velocity movement, and up to a region in which the carriage begins to decelerate from the state of the constant velocity movement and such change in velocity becomes unstable, and said printing control means operates said LPF in the first operating mode after the carriage reaches the region in which such change in velocity becomes unstable until the carriage stops.

10. The apparatus according to claim 1, wherein the printhead is an inkjet printhead that prints by discharging ink.

11. The apparatus according to claim 10, wherein the inkjet printhead is provided with an electrothermal transducer for generating heat energy to be applied to ink so as to discharge the ink by utilizing the heat energy.

12. The apparatus according to claim 1, further comprising:

second detection means for detecting a position of the printing medium with respect to the second direction;

second filter means for filtering out noise overlaying a second detection signal generated by said second detection means according to conditions which reflect a conveyance state by said conveyance means; and conveyance control means for performing conveyance control of the printing medium, based on the second detection signal from which the noise has been filtered out by said second filter means.

13. The apparatus according to claim 12, wherein said conveyance means includes a conveyance roller and conveyance gear for conveying the printing medium.

14. The apparatus according to claim 13, wherein said second detection means includes:

a disk-like scale, provided on the conveyance gear, along which transparent and opaque regions are alternately provided at predetermined intervals; and a rotary encoder, provided near the conveyance gear, that irradiates light onto the scale and generates an encoder signal as the second detection signal by detecting light that passes through any one of the transparent regions.

15. The apparatus according to claim 12, wherein said conveyance means includes a paper feed roller and conveyance gear for conveying the printing medium.

16. The apparatus according to claim 12, wherein said conveyance means includes a paper discharge roller and conveyance gear for conveying the printing medium.

17. The apparatus according to claim 14, wherein said second filter means is a low pass filter (LPF) that filters out high-frequency noise overlaying the encoder signal.

18. The apparatus according to claim 17, wherein said LPF includes:

an edge detector for detecting a leading edge and a trailing edge of the encoder signal;

a mask signal generator for generating a mask signal of a predetermined length after detecting an edge by the edge detector; and a level holder for holding a signal level of the encoder signal during a period of generating the mask signal.

19. The apparatus according to claim 18, wherein said LPF has a first operating mode for operating so that the mask signal generator generates the mask signal of a predetermined time length.

20. The apparatus according to claim 19, wherein said LPF further includes a measuring unit for measuring a cycle of the encoder signal from the leading edge and the trailing edge of the encoder signal detected by the edge detector and has a second operating mode for operating so as to generate a mask signal of a length that is 1/n times as the cycle of the encoder signal measured by the measuring unit.

21. The apparatus according to claim 20, wherein said rotary encoder generates at least a first encoder signal and a second encoder signal of different phases and said LPF further has a third operating mode for operating so as to generate the mask signal after the edge detector detects a change in signal level of the first encoder signal and until a signal level of the second encoder signal changes.

* * * * *

UNITED STATES PATENT AND TRADEMARK OFFICE

CERTIFICATE OF CORRECTION

PATENT NO. : 7,036,902 B2
APPLICATION NO. : 10/644800
DATED : May 2, 2006
INVENTOR(S) : Shoji It is certified that error appears in the above-identified patent and that said Letters Patent is hereby corrected as shown below:

COLUMN 17

Line 31, “includes” (second occurrence) should be deleted.
Line 34, “sos” should read --so--.

COLUMN 18

Line 53, “detector” should read --detector,--.
Line 55, “as” should be deleted.
Line 59, “phases” should read --phases,--.

Signed and Sealed this

Twentieth Day of March, 2007

JON W. DUDAS
*Director of the United States Patent and Trademark Office*